US010544627B2

(12) United States Patent
Yu et al.

(10) Patent No.: US 10,544,627 B2
(45) Date of Patent: Jan. 28, 2020

(54) POLYCRYSTALLINE DIAMOND CONSTRUCTIONS WITH PROTECTIVE ELEMENT

(71) Applicant: SMITH INTERNATIONAL, INC., Houston, TX (US)

(72) Inventors: Feng Yu, Lindon, UT (US); Jeffrey Bruce Lund, Salt Lake City, UT (US)

(73) Assignee: SMITH INTERNATIONAL, INC., Houston, TX (US)

( * ) Notice: Subject to any disclaimer, the term of this patent is extended or adjusted under 35 U.S.C. 154(b) by 0 days.

(21) Appl. No.: 16/066,081

(22) PCT Filed: Dec. 11, 2016

(86) PCT No.: PCT/US2016/066051
§ 371 (c)(1),
(2) Date: Jun. 26, 2018

(87) PCT Pub. No.: WO2017/116660
PCT Pub. Date: Jul. 6, 2017

(65) Prior Publication Data

US 2019/0017331 A1 Jan. 17, 2019

Related U.S. Application Data

(60) Provisional application No. 62/272,046, filed on Dec. 28, 2015.

(51) Int. Cl.

| | |
|---|---|
| ***E21B 10/573*** | (2006.01) |
| ***C22C 26/00*** | (2006.01) |
| ***E21B 10/43*** | (2006.01) |

(52) U.S. Cl.
CPC ..... *E21B 10/5735* (2013.01); *C22C 26/00* (2013.01); *E21B 10/43* (2013.01)

(58) Field of Classification Search
CPC .. C22C 1/00; C22C 1/02; C22C 26/00; E21B 10/43; E21B 10/5735
See application file for complete search history.

(56) References Cited

U.S. PATENT DOCUMENTS

| | | | |
|---|---|---|---|
| 4,764,434 | A | 8/1988 | Aronsson et al. |
| 5,667,028 | A | 9/1997 | Truax et al. |
| 6,272,753 | B2 | 8/2001 | Packer |
| 6,604,588 | B2 | 8/2003 | Eyre et al. |
| 7,951,455 | B2 | 5/2011 | Weis et al. |
| 8,297,382 | B2 | 10/2012 | Bertagnolli et al. |

(Continued)

OTHER PUBLICATIONS

International Search Report and Written Opinion issued in International Patent application PCT/US2016/066051 dated Apr. 4, 2017. 14 pages.

(Continued)

*Primary Examiner* — James G Sayre

(57) ABSTRACT

PCD constructions as disclosed comprise a ultra-hard body attached with a metallic substrate along a substrate extending between the body and the substrate. The construction includes a protective feature or element that is configured to protect a metal rich region or zone existing in the construction from unwanted effects of corrosion or erosion. The protective element extends from the body over the interface and along a portion of the substrate and may be integral with the.

20 Claims, 5 Drawing Sheets

(56) References Cited

U.S. PATENT DOCUMENTS

| | | | | |
|---|---|---|---|---|
| 8,651,203 | B2 | 2/2014 | DiGiovanni | |
| 2006/0157285 | A1* | 7/2006 | Cannon | E21B 10/36 175/374 |
| 2007/0017710 | A1 | 1/2007 | Achilles et al. | |
| 2008/0308276 | A1 | 12/2008 | Scott | |
| 2009/0152016 | A1 | 6/2009 | Eyre et al. | |
| 2011/0036641 | A1 | 2/2011 | Lyons | |
| 2011/0120782 | A1* | 5/2011 | Cooley | B24D 99/005 175/432 |
| 2012/0103699 | A1 | 5/2012 | Yu et al. | |
| 2014/0013913 | A1 | 1/2014 | Bao | |
| 2014/0069727 | A1 | 3/2014 | Belnap | |
| 2014/0338958 | A1 | 11/2014 | Yamauchi et al. | |
| 2015/0292270 | A1* | 10/2015 | Zhang | C22C 26/00 51/297 |

OTHER PUBLICATIONS

International Preliminary Report on Patentability issued in International Patent application PCT/US2016/066051 dated Jul. 12, 2018 11 pages.

First Office Action and Search Report issued in Chinese patent application 20168007683.6 dated Aug. 27, 2019, 16 pages.

* cited by examiner

POLYCRYSTALLINE DIAMOND CONSTRUCTIONS WITH PROTECTIVE ELEMENT

BACKGROUND

Polycrystalline diamond (PCD) materials and PCD elements formed therefrom are well known in the art. Conventional PCD is formed by combining diamond grains with a suitable solvent catalyst material and subjecting the diamond grains and solvent catalyst material to processing conditions of extremely high pressure/high temperature (HPHT). During such HPHT processing, the solvent catalyst material promotes desired intercrystalline diamond-to-diamond bonding between the grains, thereby forming a PCD structure. The resulting PCD structure produces enhanced properties of wear resistance and hardness, making PCD materials extremely useful in aggressive wear and cutting applications where high levels of wear resistance and hardness are desired. The fast evolution of PCD elements as used in applications such as bits for drilling subterranean formations result in longer drilling time and wider application range. In such use, PCD elements may be exposed for a longer total drilling time in more corrosive drilling environments.

Solvent catalyst materials that are typically used for forming conventional PCD include metals from Group VIII of the periodic table, with cobalt (Co) being the most common. Conventional PCD can comprise from 85 to 95 percent by volume diamond and a remaining amount of the solvent catalyst material. The solvent catalyst material is present in the microstructure of the resulting PCD material within interstices or interstitial regions that exist between the bonded together diamond grains.

The solvent catalyst material is typically provided during the HPHT process from a substrate that is to be joined together with the resulting PCD body, thereby forming a PCD compact. When subjected to the HPHT process, the solvent catalyst material within the substrate melts and infiltrates into the adjacent diamond grain volume to thereby catalyze the bonding together of the diamond grains. In such HPHT process, the solvent metal catalyst is typically supplied from the substrate, forming a metal catalyst rich zone adjacent to the interface between the PCD body and the substrate.

It is desired that polycrystalline diamond constructions be engineered in a manner so as to minimize or eliminate the unwanted corrosion or erosion of the PCD construction, to thereby minimize or eliminate any delamination or other failure mode that may be associated with conventional PCD constructions.

SUMMARY

PCD constructions as disclosed herein may be provided in the form of a cutting element construction, where such cutting element includes a diamond bonded body having a matrix of bonded together diamond crystals comprising a plurality of interstitial regions dispersed within the matrix. In an example, the body is formed from polycrystalline diamond and at least a population of the interstitial regions include a solvent metal catalyst used to sinter the body at high pressure/high temperature conditions. If desired, at portion of the polycrystalline body may be treated to render it thermally stable. A metallic substrate is attached to the body substrate along an interface extending between the body and the substrate.

A feature of PCD constructions as disclosed herein is that they include a protective element or feature that extends axially along the substrate a distance from the body and that is configured to cover an outside region of the interface. The protective element extends circumferentially along at least a part of a total diameter of the substrate. In an example, the protective element is an integral member of the body. In an embodiment, the protective element is formed from the same material used to form the construction body. In an example, the substrate includes a reduced diameter section and a remaining diameter section, wherein the protective element is disposed within the reduced diameter section and the protective element has an outside diameter that is the same an outside diameter of the diamond bonded body and substrate remaining diameter section. The protective element may have a radial thickness that is constant or that changes moving axially along the construction. The protective element may extend circumferentially around the entire diameter of the construction or over only part of the diameter.

This summary is provided to introduce a selection of concepts that are further described below in the detailed description. This summary is not intended to identify key or essential features of the claimed subject matter, nor is it intended to be used as an aid in limiting the scope of the claimed subject matter.

BRIEF DESCRIPTION OF THE DRAWINGS

These and other features and advantages of polycrystalline diamond constructions as disclosed herein will be appreciated as the same becomes better understood by reference to the following description when considered in connection with the accompanying drawings wherein.

DESCRIPTION

Figure 1:
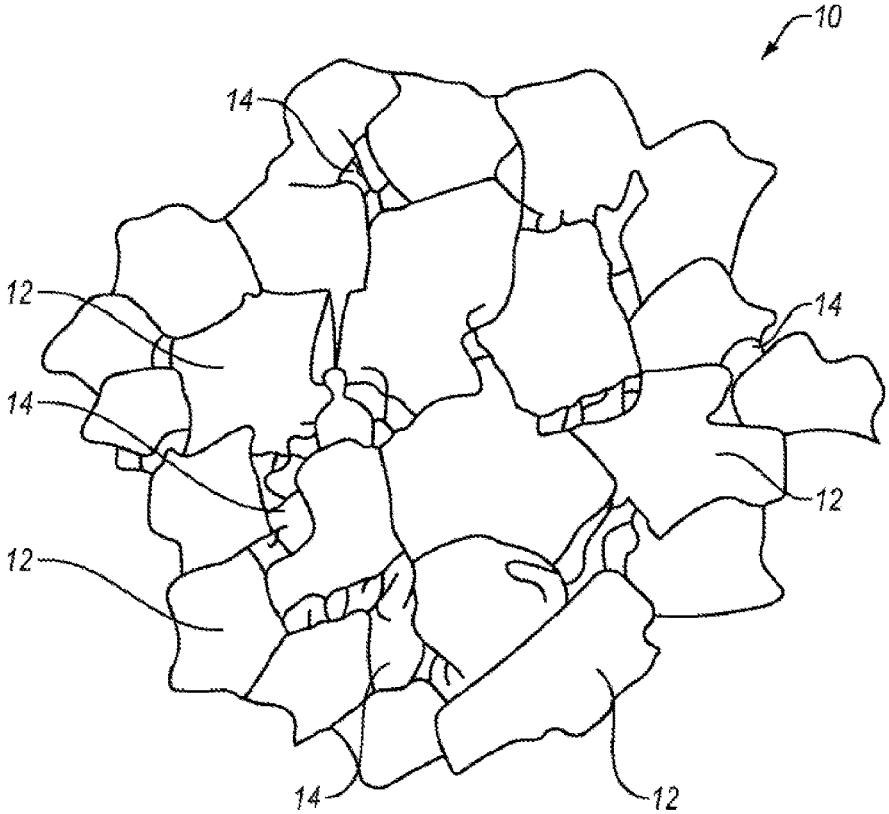
FIG. 1 is a schematic microstructural view of a region of an example polycrystalline diamond construction as disclosed herein.

Polycrystalline diamond (PCD) constructions as disclosed herein comprise a diamond bonded body attached to a substrate, and are specifically engineered to have a protective element disposed along the construction that operates to protect a solvent catalyst rich region adjacent an interface between the diamond bonded body and substrate from unwanted effects of corrosion or erosion, to thereby minimize or eliminate unwanted corrosive or erosive effects within such region to ensure a strongly bonded and uncompromised attachment between the body and substrate. When PCD constructions provided in the form of cutting elements used in subterranean drilling or the like are placed into certain end-use applications such as those having a corrosive downhole environment, e.g., due to the presence of corrosive chemical compounds such as $H_2S$, HCl, and the like, it has been discovered that such corrosive chemical compounds operate to attack or otherwise remove material constituents such as solvent catalyst metal, e.g., cobalt, along a zone rich with such material constituents along the outside surface of the construction.

When the PCD construction is provided in the form of a cutting element, the solvent metal rich zone or region exists adjacent the diamond bonded body and substrate interface, and the unwanted corrosive effects of metal depletion occur at the substrate adjacent the interface. Over time, the solvent metal catalyst in this area of the substrate outside surface is leached or otherwise removed that operates to expose the interface and underside surface of the diamond body, which may operate to weaken the attachment bond between the diamond bonded body and the substrate. Heat generated by friction between the PCD constructions and the rocks in drilling is known to accelerate the above corrosion in the zone and the neighboring substrate. Eventually, such corrosive attack of the PCD construction can cause delamination of the diamond bonded body and substrate, thereby causing failure of the cutting element and reducing the effective cutting element service life.

As used herein, the term "PCD" is used to refer to polycrystalline diamond that has been formed at HPHT conditions through the use of diamond grains or powder and an appropriate catalyst material. In an example embodiment, the catalyst material is a metal solvent catalyst that can include those metals in Group VIII of the periodic table. The solvent metal catalyst material remains within interstitial regions of the material microstructure after it has been sintered. However, as described in detail below, the PCD material may be treated to remove the catalyst material from a thermally stable region thereof, or may be treated to remove the catalyst material from the entire diamond bonded body, rendering the entire diamond bonded body thermally stable. As noted above, PCD constructions as disclosed herein are formed using a high pressure/high temperature "HPHT" process condition.

As used herein, the term "catalyst material" is understood to refer to those materials that facilitate the bonding together of the ultra-hard grains, e.g., diamond grains, during the HPHT process. When the ultra-hard material is diamond grains, the catalyst material facilitates formation of diamond crystals and/or the changing of graphite to diamond or diamond to another carbon-based compound, e.g., graphite. In the context of constructions disclosed herein, catalyst materials include those susceptible to corrosion and/or erosion attack such as solvent metal catalysts that include cobalt.

While constructions as disclosed herein are referred to as PCD constructions, it is to be understood that constructions within the scope of the embodiment disclosed herein may include ultra-hard materials other than PCD such as those having a Rockwell A hardness of greater than about 4,000. Examples of such ultra-hard materials include hNB, cBH, polycrystalline cBN, and the like. Constructions comprising such non-PCD would similarly be bonded with a metallic substrate comprising a solvent metal catalyst zone or region adjacent the ultra-hard body that would be otherwise be vulnerable to the same type of corrosive attack as described above for conventional PCD constructions.

FIG. 1 illustrates a region taken from a PCD construction 10 as disclosed herein, and that is shown to have a material microstructure comprising the following material phases. A polycrystalline matrix first material phase 12 comprises a plurality ultra-hard crystals formed by the bonding together of adjacent ultra-hard grains at HPHT conditions. A second material phase 14 is disposed interstitially between the bonded together ultra-hard crystals and comprises a catalyst material that is used to facilitate the bonding together of the ultra-hard crystals. The ultra-hard grains used to form the polycrystalline ultra-hard material can include those selected from the group of materials consisting of diamond, cubic boron nitride (cBN), and mixtures thereof. In an example embodiment, the ultra-hard grains are diamond and the resulting polycrystalline ultra-hard material is PCD.

Figure 2:
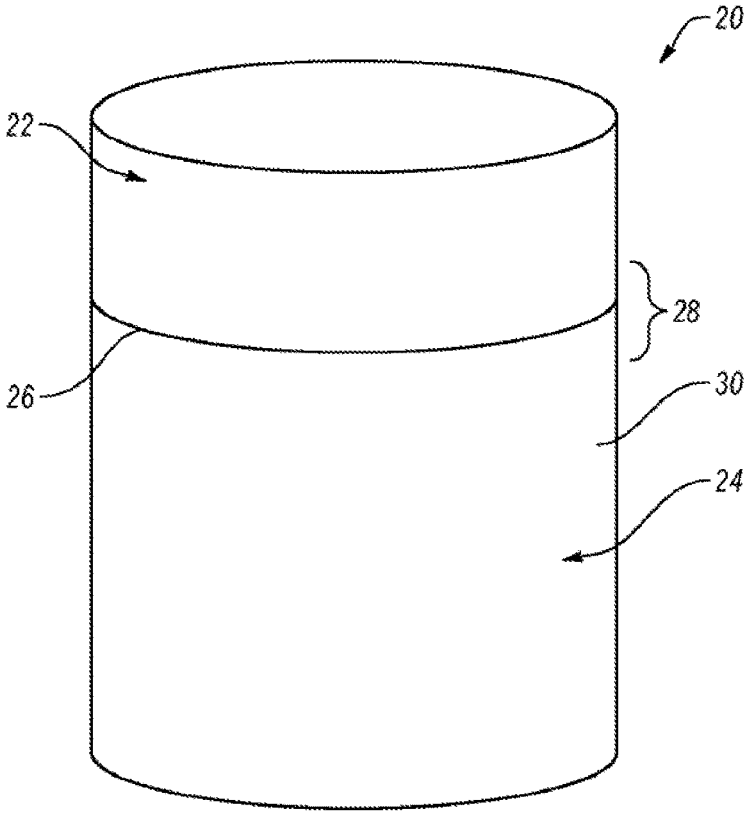
FIG. 2 (Prior Art)
FIG. 2 is a perspective view of an conventional polycrystalline diamond construction illustrating a region or zone susceptible to corrosion or erosion when placed into use, according to an embodiment of the invention.

FIG. 2 illustrates a conventional PCD construction 20 comprising a PCD body 22 that is attached to a metallic substrate 24, wherein the attachment bond occurs along an interface 26 between the body 22 and the substrate 24. The metallic substrate is a conventional metallic substrate used to form PCD constructions. For example, the metallic substrate may comprise cemented tungsten carbide (WC—Co), wherein cobalt is a solvent metal catalyst. As noted above, such a conventional construction comprises a metal solvent catalyst or "metal" rich zone 28 having an axial thickness within the construction adjacent the interface and extending radially throughout the construction to an outer sidewall surface 30. Such metal rich zone 28 as it exists in the substrate is susceptible to corrosion attack and removal (e.g., leaching) of the solvent metal catalyst (e.g., cobalt) along this sidewall surface. Additionally, depending on the particular end-use application and application environment, such metal rich zone as present in the substrate may be susceptible to erosion, which also may cause removal of the solvent metal catalyst therefrom. Over time, such corrosive and/or erosive attack operates to remove solvent catalyst material from the sidewall surface 30, eventually exposing the interface and underside of the PCD body and reducing the bonded interface area, which may result in unwanted delamination of the body from the substrate.

Figure 3:
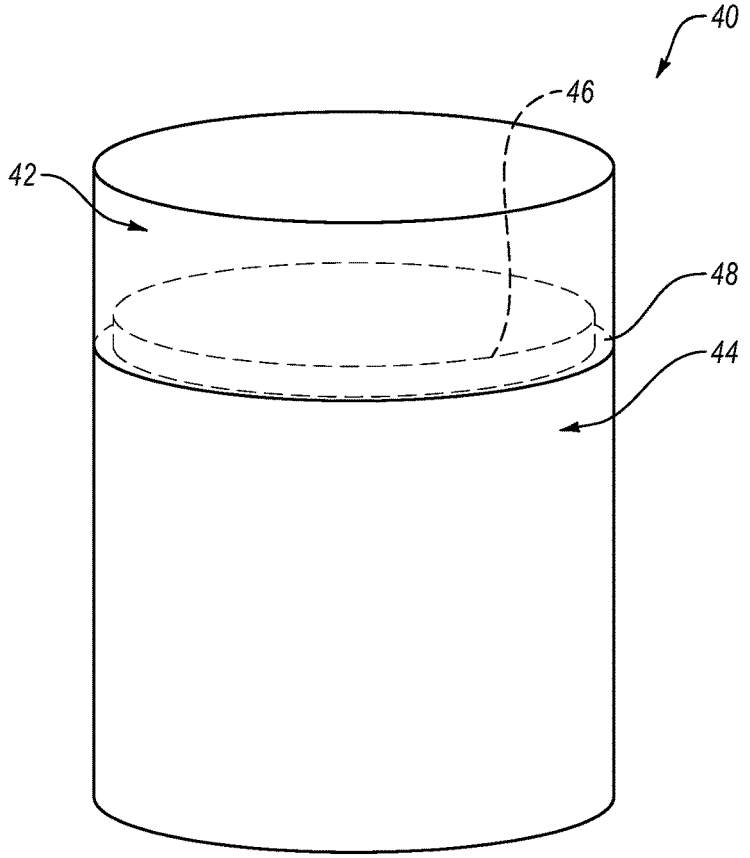
FIG. 3 is a perspective view of a polycrystalline diamond construction, according to an embodiment of the invention.
Figure 4:
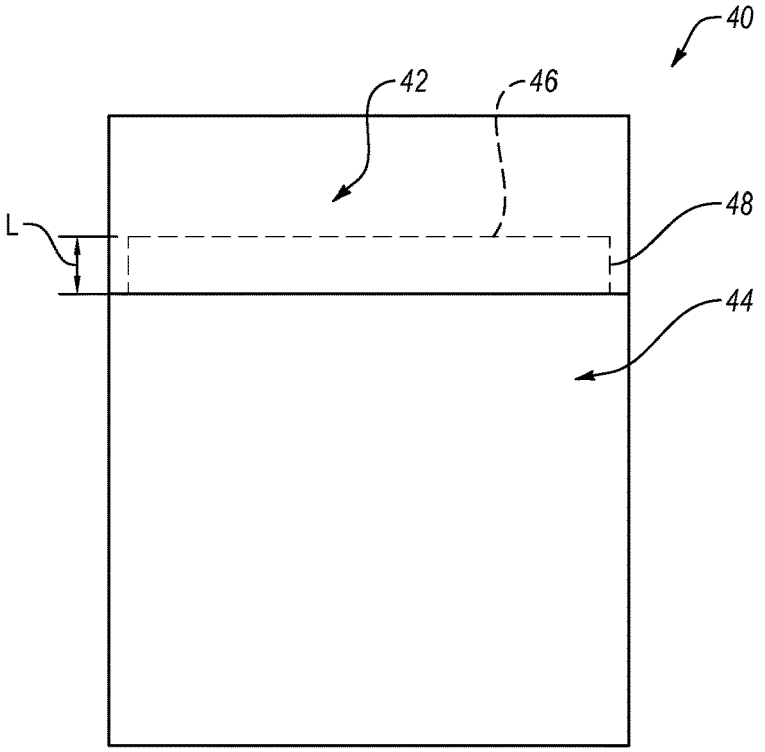
FIG. 4 is a side view of the polycrystalline diamond construction illustrated in FIG. 2, according to an embodiment of the invention.
Figure 5:
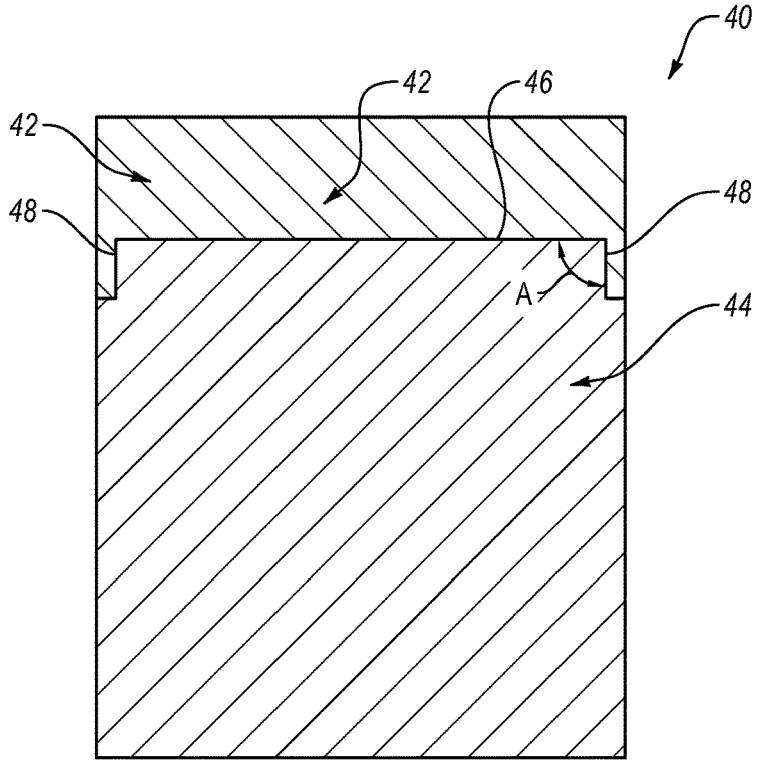
FIG. 5 is a cross-sectional side view of the polycrystalline diamond construction illustrated in FIGS. 3 and 4, according to an embodiment of the invention.

FIGS. 3 to 5 illustrate an example PCD construction 40, according to an embodiment of the invention, comprising an ultra-hard body 42, such as a PCD body, that is bonded together with a metallic substrate 44 along an interface 46 between the body and substrate. The metallic substrate 44 may be a conventional metallic substrate used to form PCD constructions, such as WC—Co comprising cobalt as a solvent metal catalyst. A feature of such PCD construction is that it includes a protective feature or element 48 in the form of a band that extends axially downwardly from the interface 46 to a distance over a sidewall surface of the substrate 44, and that extends circumferentially around a diameter of the construction along this region. In an example, the protective element or band 48 is formed from an ultra-hard material that is significantly less susceptible to metal corrosive or erosive attack as compared to the susceptibility of the solvent metal catalyst material alone. In an example, the ultra-hard material may be formed from PCD.

In an example where the body is formed from PCD, and PCD is used to form the protective element, the PCD used to form the protective element may have the same constituent composition as the body, or may be formed having a different diamond volume content and/or having a different diamond grain size. In an embodiment, the protective element is integral with the body forming a one-piece construction along with the body. In an embodiment, the diamond volume content of the PCD used to form the protective element is higher than the diamond volume content of the PCD in the body to provide an added level or degree of protection against unwanted corrosive or erosive metal attack. In an example wherein the diamond volume content in the PCD body is approximately 85 percent, the PCD used to form the protective feature may have a diamond volume content of greater than 85 percent, and possibly greater than 95 percent depending on the particular end-use application and application environment.

In the embodiment illustrated in FIGS. 3 to 5, it is desired that the protective band 48 have an axial length "L" (as measured from the interface) that is sufficient to provide a desired degree of protection to the metal rich zone to protect it against unwanted corrosion and erosion, while at the same time not impairing desired interface properties of the construction and maintaining sufficient substrate exposure for brazing cutters formed from the construction into a drill bit. In an example, the axial length may be at least about 25 micrometers, from about 25 micrometers to 5,000 micrometers, from about 50 micrometers to 500 micrometers, and from about 75 micrometers to 250 micrometers. In an embodiment, the finishing tolerance is approximately 127 micrometers. While certain axial lengths for the protective band have been provided, it is to be understood that the exact axial length can and may vary from such provided amounts depending factors including but not limited to the size of the PCD construction, the materials, volume amounts, and sizes of the materials to form the PCD body and/or the substrate, and the particular end-use application and application environment.

In the embodiment of FIGS. 3 to 5, it is desired that the protective band 48 have a radial thickness that is sufficient to provide a desired degree of protection to the metal rich zone of the substrate to protect it against unwanted corrosion and erosion, while at the same time not impairing desired interface properties of the construction. Because the protective band is not engaged in the operation of cutting or gouging a downhole surface for removal, the layer thickness of the material does not need to have properties similar to a wear surface of the PCD construction, and only needs to be an amount sufficient to cover and protect the metal rich zone surface against corrosion or erosion. For example, the radial width or thickness may be at least about 25 micrometers, from about 25 micrometers to 500 micrometers, and from about 125 micrometers to 255 micrometers. While certain band radial thicknesses have been provided, it is to be understood that the exact radial thickness can and may vary from such provided amounts depending factors including but not limited to the size of the PCD construction, the materials, volume amounts, and sizes of the materials to form the PCD body and/or the substrate, and the particular end-use application and application environment.

Figure 6:
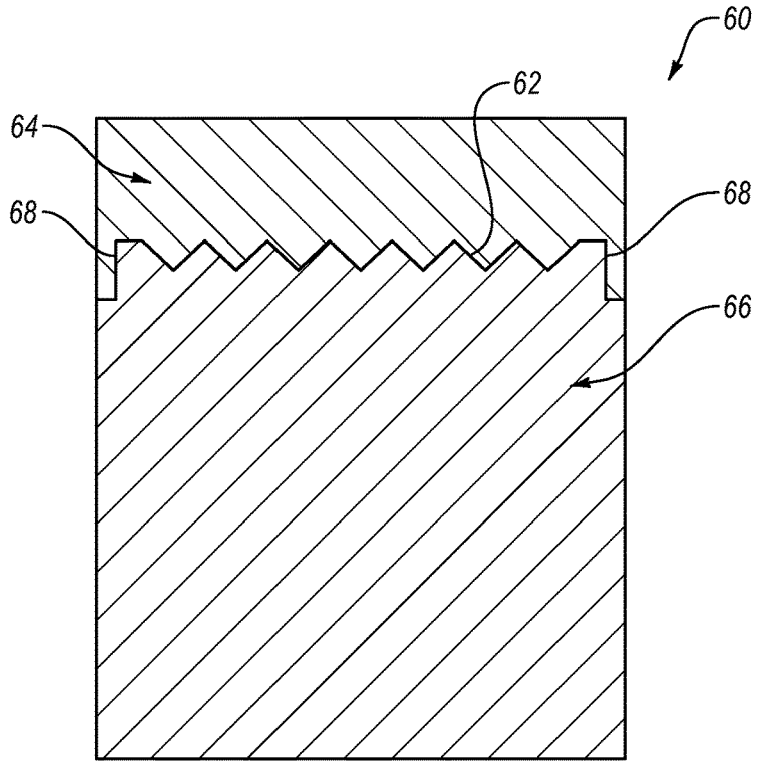
FIG. 6 is a cross-sectional side view of the polycrystalline diamond construction similar to that illustrated in FIG. 4, according to an embodiment of the invention.

While the PCD constructions of FIGS. 3 to 5 appear to show an interface 46 that is planar, it is to be understood that PCD constructions as disclosed herein may also be used with substrates having nonplanar interfaces. Non planar interface features may provide, for example, an added level of bonding and mechanical interface attachment. FIG. 6 illustrates an example PCD construction 60 as disclosed herein having an example nonplanar interface 62 between the PCD body 64 and substrate 66 for purposes of reference, and comprising the protective element 68 in the form of a continuous band. Accordingly, it is to be understood PCD constructions as disclosed herein are intended to include uses with all different types of interface geometries that are both planar and nonplanar.

Referring back to the example PCD construction of FIGS. 3 to 5, the protective band 48 may have a constant radial thickness as defined by the inside wall surface of the substrate. As best illustrated in FIG. 5, the protective band in this example PCD construction has a constant radial thickness along its axial length, and has an angle of departure "A" (as measured along an axis parallel to the interface) of approximately 90 degrees as defined by the inside wall surface of the substrate. A feature of the protective element is that it operates to provide the desired degree of protection of the metal rich zone without compromising attachment strength along the interface. Using a 90 degree angle of departure operates to maximize the remaining surface area long the interface for attachment between the substrate and body.

Figure 7:
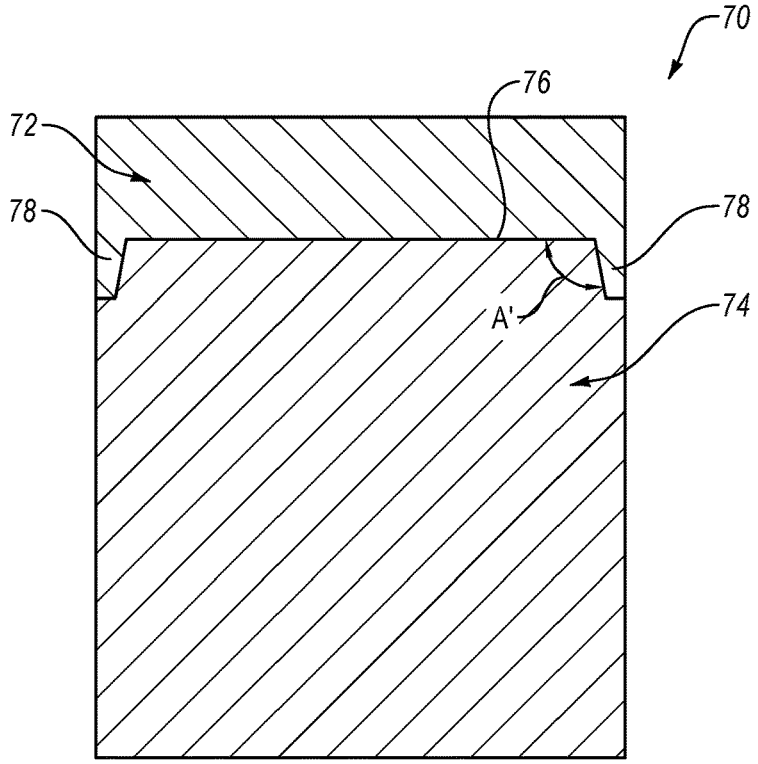
FIG. 7 is a cross-sectional side view of a diamond construction, according to an embodiment of the invention.

FIG. 7 illustrates an example PCD construction 70 as disclosed herein comprising a PCD body 72 attached to a substrate 74 along an interface 76 and comprising a protective element 78 extending along a metal rich region of the substrate. Unlike the example illustrated in FIGS. 3 to 5, the protective element 78 has a degree of departure "A" that is greater than 90 degrees, provided by a radially-outwardly tapered inside wall surface (moving downwardly from the interface), which also gives rise to a protective element thickness that is not constant and that decreases moving downwardly from the interface. In such example, the angle of departure may be greater than 90 degrees, for example, from about 100 to 180 degrees, or between about 90 to 105 degrees. In certain PCD constructions, providing a protective band configured in this manner, having a tapered radial width, may operate to provide the desired degree or protection without compromising attachment strength along the interface.

Figure 8:
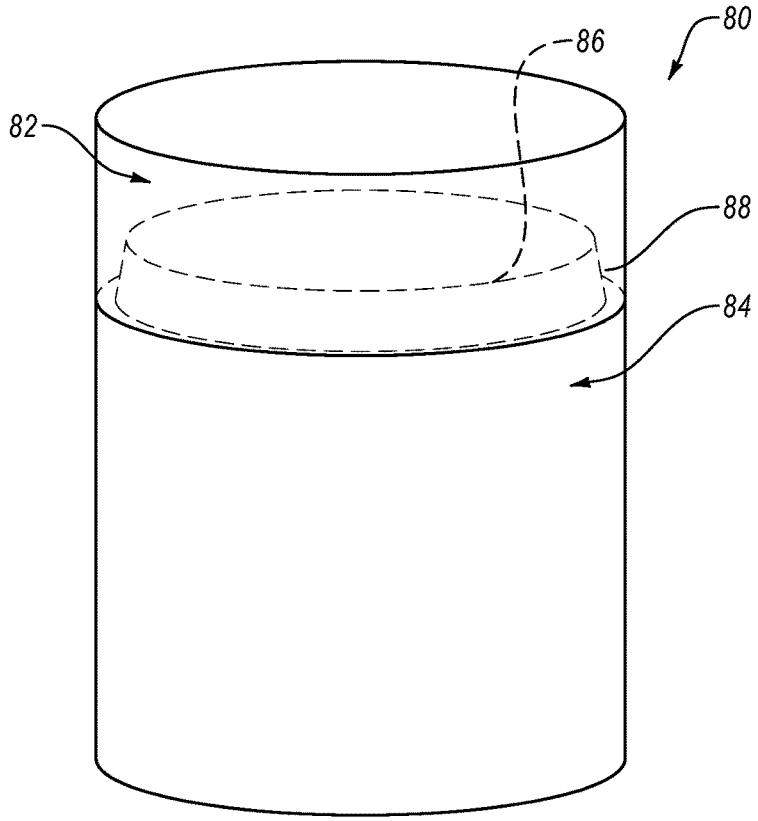
FIG. 8 is a perspective view of a polycrystalline diamond construction, according to an embodiment of the invention.

FIG. 8 illustrates an example PCD construction 80 as disclosed herein somewhat similar to that disclosed above comprising a PCD body 82 attached to a substrate 84 along an interface 86. However, unlike the example disclosed above and illustrated in FIGS. 3 to 5, the protective element 88 for this example is provided in the form of one or more discrete elements or patches instead of a continuous band extending along and covering the entire circumference of the metal rich zone. A protective element in the form of a continuous band may be useful for certain end-use applications, e.g., those where a majority or the entirety of the PCD construction sidewall surface is exposed to a corrosive or erosive element, and/or reusing an element by rotating the element so that a different portion of the edge is exposed. In another embodiment, only a portion of the PCD cutting element may be exposed to a corrosive or erosive element, and/or a desired degree of substrate exposure is useful for purposes of attaching, e.g., brazing the construction to a drill bit during manufacturing. In such applications, the use of one or more discrete protective elements operates to provide a desired degree of corrosion and erosion protection while optimizing the time and cost of manufacturing the same. In such example, the protective element 88 is formed in the same manner described above, and may have an axial length, radial thickness, and angle of departure as described above. It is to be understood that the exact placement location and the sectional length of the protective element can and will vary depending on the particular end-use application. In an example, a single discrete protective element may cover at least 10 percent, and from about 20 to 90 percent of the total construction circumference. A number of such discrete elements may be used to cover a desired amount of the total construction circumference.

In examples where the ultra-hard material in the construction is PCD, diamond grains used for forming the resulting diamond bonded body during the HPHT process include diamond powders having an average diameter grain size in the range of from submicrometer in size to about 0.1 mm, from about 0.002 mm to about 0.08 mm, or from about 0.008 to 0.04 mm. The diamond powder can contain grains having a mono or multi-modal size distribution. In an embodiment, the diamond powder has an average particle grain size of approximately 5 to 50 micrometers.

However, it is to be understood that the diamond grains having a grain size greater than or less than this amount can be used depending on the particular end use application. For example, when the polycrystalline ultra-hard material is provided as a compact configured for use as a cutting element for subterranean drilling and/or cutting applications, the particular formation being drilled or cut may impact the diamond grain size selected to provide desired cutting element performance properties. In the event that diamond powders used have differently sized grains, the diamond grains are mixed together by conventional process, such as by ball milling or turbula mixing for as much time as necessary to ensure a substantially uniform mix and desired particle size distribution.

The diamond powder used to prepare the sintered diamond bonded body can be synthetic diamond powder. Synthetic diamond powder may include small amounts of solvent metal catalyst material and other materials entrained within the diamond crystals themselves. Alternatively, the diamond powder used to prepare the diamond bonded body can be natural diamond powder. The diamond grain powder, whether synthetic or natural, can be combined with a desired amount of catalyst material to facilitate desired intercrystalline diamond bonding during HPHT processing.

Suitable catalyst materials useful for forming the PCD body are metal solvent catalysts that include those metals selected from the Group VIII of the periodic table, with cobalt (Co) being the most common, and mixtures or alloys of two or more of these materials. The diamond grain powder and catalyst material mixture can comprise from about 85 to 95 percent by volume diamond grain powder and the remaining amount catalyst material. In certain applications, the mixture can comprise greater than about 95 percent by volume diamond grain powder. In an example embodiment, the solvent metal catalyst is introduced into the diamond grain powder by infiltration during HPHT processing from a substrate positioned adjacent the diamond powder volume.

In certain applications it may be desired to have a diamond bonded body comprising a single diamond-containing volume or region, while in other applications it may be desired that a diamond bonded body be constructed having two or more different diamond-containing volumes or regions. For example, it may be desired that the diamond bonded body include a first diamond-containing region extending a distance from a working surface, and a second diamond-containing region extending from the first diamond-containing region to the substrate. Such diamond-containing regions can be engineered having different diamond volume contents and/or be formed using differently sized diamond grains. It is, therefore, understood that PCD constructions as disclosed herein may include one or more regions comprising different ultra-hard component densities and/or grain sizes, e.g., diamond densities and/or diamond grain sizes, as called for by a particular cutting and/or wear end use application.

Suitable materials useful as the substrate include those materials used as substrates for forming conventional PCD compacts, such as those formed from ceramic materials, metallic materials, cement materials, carbides, nitrides, and mixtures thereof. In an embodiment, the substrate is provided in a preformed rigid state and includes a metal solvent catalyst constituent that is capable of infiltrating into the adjacent diamond powder volume during HPHT processing to facilitate both sintering and providing a bonded attachment with the resulting sintered diamond bonded body. Suitable metal solvent catalyst materials include those selected from Group VIII elements of the periodic table as noted above. In an embodiment, the metal solvent catalyst is cobalt (Co), and the substrate material is cemented tungsten carbide (WC—Co).

The substrate used for forming PCD constructions as disclosed herein is configured having a reduced outside diameter section that provides for the protective element as described above. The reduced outside diameter section extends axially a distance away from a diamond body interface surface (corresponding to the axial length of the protective element as described above), and has a diameter that is reduced an amount from the remaining substrate diameter (corresponding to the radial thickness of the protective element as described above). The substrate outside diameter section may be constant along the axial length or tapered as described above with reference to the substrate inside sidewall surface. The reduced diameter section may be formed by machining or molding or by other method known in the art, and in an example is formed by machining.

In an example, the substrate is loaded into a container and a desired volume of diamond grains useful for forming the PCD body are disposed onto the substrate. The diamond grains may migrate along the reduced diameter section during the step of adding the volume of diamond grains to the container. If desired, an adhesive may applied to the substrate reduced diameter section and diamond grains may be adhered thereto, e.g., by spray, dip, brush or other technique, before placing the substrate into the container and adding the volume of diamond grains, e.g., to ensure that placement of the diamond grains in the substrate reduced diameter section to ensure formation of the protective element from sintered PCD. Alternatively, diamond grains in the form of tape or the like, wherein the diamond grains are provided in a flexible polymer form, may be used to ensure placement of the placement of the diamond grains within the substrate reduced diameter section. These are but a few techniques that may be used to ensure that the ultra-hard material used to form the protective element is disposed along the substrate reduced diameter section prior to sintering. In the event that adhesives or tapes or other techniques using a binding agent or the like is used it is desired, prior to HPHT processing, that the container and its contents be subjected to elevated temperature (which may be in a vacuum environment) sufficient to drive off or volatize the binding agents.

As noted above, it may be desired to form the protective element from a material having a different composition than that of the ultra-hard body. In such an embodiment, the material used to form the protective element may be provided in the substrate reduced diameter section in any one or the methods described above.

The loaded container is configured for placement within a suitable HPHT consolidation and sintering device. The HPHT device is activated to subject the container and its contents to HPHT conditions sufficient to melt the solvent metal catalyst in the substrate for diffusion into the diamond grain volume for forming the PCD body and the protective element. If desired, the solvent catalyst material may be mixed with the diamond grain volume and the substrate that is selected may or may not include a solvent metal catalyst. In an example, the HPHT device is controlled so that the container is subjected to a HPHT process comprising a pressure in the range of from 5 to 7 GPa and a temperature in the range of from about 1,320 to 1,600° C., for a period of time from about 50 to 500 seconds. During the HPHT process, the solvent metal catalyst melts and infiltrates into the diamond grain volume to facilitate intercrystalline diamond bonding sintering the PCD body and forming the protective element. Thus, a feature of the constructions as disclosed herein is the protective element may be formed during the same HPHT process used to sinter the PCD body and attached the substrate thereto.

While a particular method has been disclosed where the PCD body and protective element is formed during a single HPHT process, if desired, the protective element may be formed subsequent to formation of the PCD body during a subsequent HPHT process.

If desired, e.g., for certain end-use applications calling for an improved degree of thermal stability, it may be desired that the ultra-hard material or PCD body be treated to remove the catalyst material from the interstitial regions of a selected region of the body. This can be done, for example, by removing substantially all of the catalyst material from the selected region by suitable process, e.g., by acid leaching, aqua regia bath, electrolytic process, chemical processes, electrochemical processes, ultrasonic processes, or combinations thereof.

It is desired that the selected region where the catalyst material is to be removed, or the region of the diamond bonded body that is to be rendered substantially free of the catalyst material, be one that extends a determined depth from a surface, e.g., a working or cutting surface, of the diamond bonded body independent of the working or cutting surface orientation. Again, it is to be understood that the working or cutting surface may include more than one surface portion of the diamond bonded body that may be a top and/or side surface of the diamond bonded body.

In an example, it is desired that the region rendered substantially free of the catalyst material extend from a working or cutting surface of the diamond bonded body a depth that is calculated to sufficient to provide a desired improvement in thermal stability to the diamond body. Thus, the exact depth of this region is understood to vary depending on such factors as the diamond density, the diamond grain size, the ultimate end use application, and the desired increase in thermal stability.

In an example, the region can extend from the working surface to an average depth of at least about 0.02 millimeters, from about 0.02 millimeters to about 0.1 millimeters, from about 0.04 millimeters to an average depth of about 0.08 millimeters. In another example, e.g., for more aggressive tooling, cutting and/or wear applications where an even greater degree of thermal stability is needed, the region rendered substantially free of the catalyst material can extend a depth from the working surface of greater than about 0.1 millimeters, e.g., from about 0.1 mm to 0.45 mm.

The targeted region for removing the catalyst material can include any surface region of the diamond bonded body, including, and not limited to, the diamond table, a beveled section extending around and defining a circumferential edge of the diamond table, and/or a sidewall portion extending axially a distance away from the diamond table towards or to the substrate interface. Accordingly, in an example, the region rendered substantially free of the catalyst material can extend along the diamond table and then around the sidewall surface of the diamond bonded body a distance that may reach the substrate interface.

It is to be understood that the depth of the region removed of the catalyst material is represented as being a nominal, average value arrived at by taking a number of measurements at preselected intervals along this region and then determining the average value for all of the points. The remaining/untreated region of the diamond bonded body is understood to still contain the catalyst material uniformly distributed therein, and comprises the PCD material described above.

Additionally, when the diamond bonded body is treated, it is desired that the selected depth of the region to be rendered substantially free of the catalyst material be one that allows a sufficient depth of remaining PCD so as to not adversely impact the attachment or bond formed between the diamond bonded body and the substrate. In an example, it is desired that the untreated or remaining PCD region within the diamond bonded body have a thickness of at least about 0.01 millimeters as measured from the substrate. It is, however, understood that the exact thickness of the remaining PCD region can and will vary from this amount depending on such factors as the size and configuration of the compact, and the particular PCD compact application.

If desired, PCD constructions as disclosed herein may be formed such that the entire diamond bonded body is rendered thermally stable. In such an example, the thermally stable diamond body may be formed by first forming a polycrystalline diamond body in the manner noted above, by subjecting a volume of diamond grains to a HPHT process to sinter the diamond grains in the presence of a solvent metal catalyst. The source of the solvent metal catalyst may diffuse from a substrate during the HPHT process, e.g., such as one of the substrates disclosed above. In such example, a protective element would not be formed as the substrate would be sacrificial as it would only be used as the catalyst source would not be used in forming the PCD construction as disclosed herein comprising the protective element. In such example, once the sintered PCD body is formed, the entire diamond body would be treated to render it thermally stable, in which case the substrate would either be removed before or after the treatment process, leaving the thermally stable polycrystalline diamond body or "TSP" body. Alternatively, the solvent metal catalyst may be mixed together with the diamond grains, in which case a substrate is not used and the diamond grain and solvent metal catalyst mixture is subjected to HPHT process to form the sintered PCD body. The resulting entire PCD body would then be treated as described above to render it thermally stable, forming a TSP body.

Once the TSP body is formed, it would be loaded into a container with a substrate having the reduced diameter section, and such section would include a volume of ultra-hard material, e.g., diamond grains that may be provided in the manner disclosed above. The container and its contents would be subjected to an HPHT process for the purpose of attaching the TSP body to the substrate and formation of the protective element. The resulting construction would look the same as that illustrated in FIG. 3, and comprises a TSP body attached with a substrate and comprising a protective element disposed along a region of the substrate adjacent the interface. The protective element in such example functions in the same manner as described above for PCD constructions comprising a PCD body that is not a TSP body.

A feature of PCD constructions as disclosed herein is the feature of a protective element that has been intentionally engineered for purposes of protecting a designated region of the construction adjacent the interface from the unwanted effects of corrosion or erosion when placed into an end-use application. Accordingly, such protective element to ensure that a strong attachment between the ultra-hard body not be compromised due to material loss caused by corrosive or erosive attack, to thereby protect against unwanted delamination to provide an improved duration of service life.

PCD constructions as disclosed herein may be used in a number of different applications, such as tools for mining, cutting, machining and construction applications. PCD constructions as disclosed herein are particularly well suited for use as working, wear and/or cutting components in machine tools and drill and mining bits, such as roller cone rock bits, percussion or hammer bits, diamond bits, and shear cutters used for drilling subterranean formations.

Figure 9:
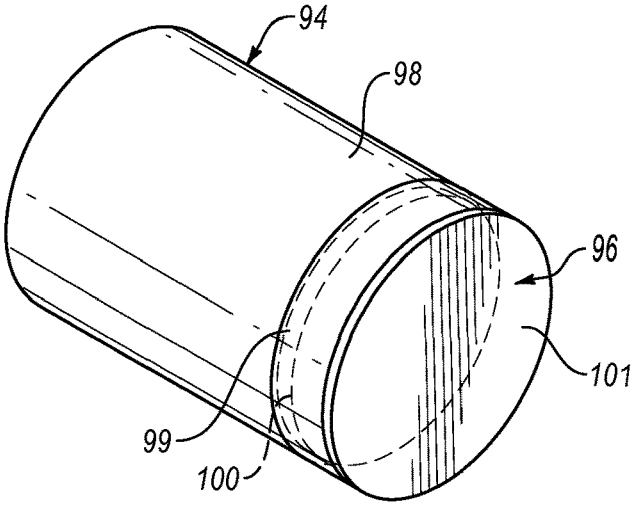
FIG. 9 is a perspective view of a shear cutter comprising the polycrystalline diamond construction, according to an embodiment of the invention.

FIG. 9 illustrates a PCD construction as disclosed herein embodied in the form a shear cutter 94 used, for example, with a drag bit for drilling subterranean formations. The shear cutter 94 comprises a diamond bonded body 96 that is sintered or otherwise attached to a cutter substrate 98 and that comprises a protective element 99 as described above extending axially from the body over the interface 100. The diamond bonded body 96 includes a working or cutting surface 101.

Figure 10:
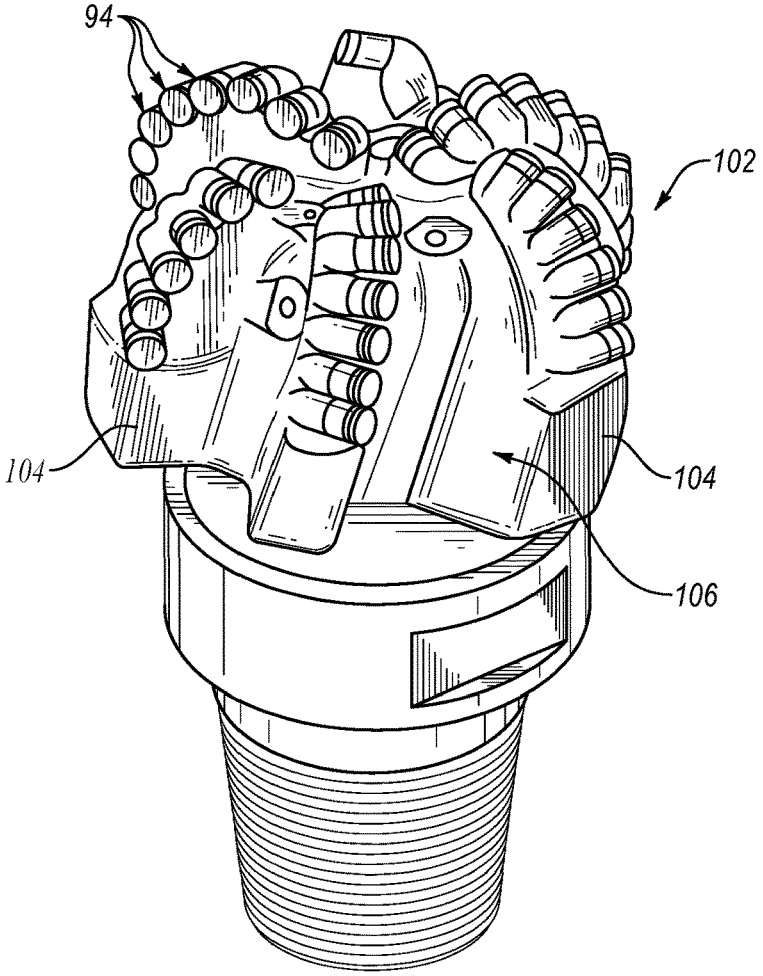
FIG. 10 is a perspective view of a drag bit comprising a number of the shear cutters of FIG. 9, according to an embodiment of the invention.

FIG. 10 illustrates a drag bit 102 comprising a plurality of the shear cutters 94 described above and illustrated in FIG. 9. The shear cutters are each attached to blades 104 that extend from a head 106 of the drag bit for cutting against the subterranean formation being drilled.

Although only a few example embodiments of PCD constructions, method for making the same, and devices comprising the same have been described in detail above, those skilled in the art will readily appreciate that many modifications are possible in the example embodiments without materially departing from the concepts as disclosed herein. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112, paragraph 6 for any limitations of any of the claims herein, except for those in which the claim expressly uses the words 'means for' together with an associated function.

What is claimed is:

1. A cutting element construction comprising:

a polycrystalline diamond body comprising a matrix of bonded together diamond crystals and a plurality of interstitial regions dispersed within the matrix, wherein the body has a top surface and a side wall surface extending axially downwardly from the top surface, wherein the side wall surface is cylindrical having a substantially constant diameter;

a metallic substrate attached to the polycrystalline diamond body along an interface extending between the polycrystalline diamond body and the substrate, wherein the substrate includes a reduced diameter section having a diameter that is less than a diameter of the body side wall surface and that projects outwardly into a recessed section of the body, and wherein the substrate includes a remaining diameter section that extends radially outwardly from a wall surface of the reduced diameter section to an outside wall surface of the substrate; and a protective element comprising a band that extends circumferentially within at least part of an annular space between the substrate reduced diameter section wall surface and along the substrate remaining diameter section, wherein the band extends axially along the body side wall surface to the substrate remaining diameter section and extends beyond a region of the interface existing between a top surface of the substrate reduced diameter section and the body, wherein the band is integral with the polycrystalline diamond body, and wherein the band has a diamond volume content that is different from a diamond volume content in the body.

2. The cutting element construction as recited in claim 1 wherein the protective element has an outside diameter that is substantially equal to both an outside diameter of the polycrystalline diamond body side wall surface and an outside diameter of the substrate.

3. The cutting element construction as recited in claim 1 wherein the protective element has an angle of departure relative to the interface between the top surface of the substrate reduced diameter section and the body of 90degrees or more.

4. The cutting element construction as recited in claim 1 wherein the protective element has a radial thickness that is substantially constant along the axial length of the protective element.

5. The cutting element construction as recited in claim 1 wherein the protective element has a radial thickness that changes along the axial length of the protective element.

6. The cutting element construction as recited in claim 1 wherein the protective element diamond volume content is greater than the diamond volume content in the polycrystalline diamond body.

7. The cutting element construction as recited in claim 1 wherein the protective element extends an axial length of from about 50 to 500 micrometers.

8. The cutting element construction as recited in claim 1 wherein the protective element extends circumferentially around the entire annular space of the substrate.

9. The cutting element construction as recited in claim 1 comprising more than one protective elements that are spaced apart from one another circumferentially.

10. The cutting element construction as recited in claim 1 wherein the protective element has a radial thickness of at least 25 micrometers.

11. A drill bit comprising a bit body and a number of the cutting element constructions as recited in claim 1 connected thereto.

12. A drill bit comprising:

a bit body having a number of cutting elements operatively attached thereto, the cutting elements comprising:

a polycrystalline diamond body comprising a matrix of bonded together diamond crystals with a plurality of interstitial regions dispersed within the matrix, the body having a top surface and a cylindrical wall structure extending axially away from the top surface;

a metallic substrate joined together with the polycrystalline diamond body along an interface, wherein the body includes an inwardly recessed section and the substrate includes an outwardly projecting reduced diameter section that is disposed within the body inwardly recessed section, the substrate having a generally cylindrical outside wall surface; and a protective element extending circumferentially around a wall section of the substrate reduced diameter section to an outside diameter of the substrate and extending axially from the polycrystalline diamond body wall structure, wherein the protective element extends axially over a region of the interface between the body recessed section and the substrate reduced diameter section that is rich in metal-solvent catalyst material wherein the protective element is formed from polycrystalline diamond and has a radial thickness of at least 25 micrometers, and wherein the protective element has an outside diameter that is the same as the polycrystalline diamond body.

13. The drill bit as recited in claim 12 wherein the protective element is in the form of an annular band and has a radial thickness that is constant.

14. The drill bit as recited in claim 12 wherein the protective element has an axial length of from about 75 to 250 micrometers as measured from an interface of the protective element with the substrate.

15. The drill bit as recited in claim 12 wherein the protective element has a diamond volume content greater than the diamond volume content in another region of the polycrystalline diamond body.

16. A method for making a diamond bonded construction comprising:

placing a volume of diamond grains adjacent to an interface surface of a metallic substrate, wherein the metallic substrate comprises a reduced diameter section extending axially outwardly a distance from a remaining section of the substrate, wherein the volume of diamond grains and the metallic substrate form an assembly; and subjecting the assembly to a high pressure/high temperature process condition to sinter the diamond volume in the presence of a solvent metal catalyst to form a polycrystalline diamond body, to attach the polycrystalline body to the substrate, wherein a protective element of polycrystalline diamond is formed during the step of subjecting that extends axially from the body and fills an annular space between a wall surface of the substrate reduced diameter section and an outside diameter of the substrate, wherein the protective element has a diamond volume content that is different than a diamond volume content in another region of the polycrystalline diamond body.

17. The method as recited in claim 16 wherein during the step of subjecting, the polycrystalline diamond body and protective element are integrally combined.

18. The method as recited in claim 16 wherein before the step of placing, configuring the substrate to have the reduced diameter section, wherein the reduced diameter section has a constant diameter.

19. The method as recited in claim 16 wherein during the step of subjecting, the protective element has a radial thickness of at least about 25 micrometers, and wherein the protective element has an outside diameter that is the same as the outside diameter of the polycrystalline diamond body.

20. The method as recited in claim 16 wherein the protective element has an axial length of from about 50 to 500 micrometers as measured from an interface of the protective element with the remaining section of the substrate.

* * * * *